United States Patent [19]

Goluba

[11] Patent Number: 4,832,637

[45] Date of Patent: May 23, 1989

[54] MARINE ENGINE DRIVESHAFT COUPLING

[75] Inventor: James I. Goluba, Ripon, Wis.

[73] Assignee: Brunswick Corporation, Skokie, Ill.

[21] Appl. No.: 55,698

[22] Filed: May 29, 1987

[51] Int. Cl.[4] ..... B63H 23/04

[52] U.S. Cl. ..... 440/83; 403/359; 403/360

[58] Field of Search ..... 440/83, 49; 285/330, 285/91 A; 403/359, 360, 375; 267/260; 464/97, 179

[56] References Cited

U.S. PATENT DOCUMENTS

| | | | |
|---|---|---|---|
| 2,016,753 | 10/1935 | Patzig | 267/260 |
| 2,346,432 | 4/1944 | Heintz | 464/97 |
| 2,676,820 | 4/1954 | Boice | 285/333 |
| 2,789,812 | 4/1957 | Ruegg | 267/260 |
| 3,321,988 | 5/1967 | Peras | 464/97 |
| 3,337,221 | 7/1967 | Hulsebus et al. | 277/8 |
| 3,350,879 | 11/1967 | Boda et al. | 60/31 |
| 3,399,549 | 9/1968 | Nalgele | 403/359 |
| 3,890,803 | 6/1975 | Neal | 464/97 |
| 3,938,398 | 2/1976 | Bloom | 403/359 |
| 4,012,155 | 3/1977 | Morris | 403/360 |
| 4,061,279 | 12/1977 | Sautter | 464/97 |
| 4,076,436 | 2/1978 | Slater | 285/333 |
| 4,127,080 | 11/1978 | Lakiza | 464/97 |
| 4,201,066 | 5/1980 | Nolan | 464/97 |
| 4,354,808 | 10/1982 | Ilg | 403/360 |
| 4,432,245 | 2/1984 | Hattori | 464/97 |
| 4,445,529 | 5/1984 | Lagarelli | 403/359 |
| 4,523,872 | 6/1985 | Arena | 403/359 |
| 4,606,671 | 8/1986 | Rasmussen | 403/359 |
| 4,617,884 | 10/1986 | Botten | 403/359 |
| 4,650,428 | 3/1987 | Bland | 440/83 |
| 4,657,428 | 4/1987 | Wiley | 403/359 |
| 4,689,027 | 8/1987 | Harada | 440/83 |
| 4,747,796 | 5/1988 | Iwai | 464/97 |

*Primary Examiner*—Joseph F. Peters, Jr.
*Assistant Examiner*—Clifford T. Bartz
*Attorney, Agent, or Firm*—Andrus, Sceales, Starke & Sawall

[57] ABSTRACT

A marine engine crankshaft (2) is coupled to a driveshaft (19) for driving a propeller. The splined portion (20) of the upper end of the driveshaft is provided with means to reduce the driveshaft rigidity by providing an intermediately positioned groove or undercut (22) therein. The depth of the undercut is contemplated as being approximately the same as the channels (21) between the splines, and the axial extent or length (A-B) of the undercut is contemplated as being approximately equal to or greater than the undercut depth. In the assembled unit, the undercut is positioned at the outer terminus of the crankshaft. The result is a coupling wherein the rigidity of the driveshaft is reduced and it is free to flex more easily at the intersection of the members so that fatigue failure is substantially reduced.

5 Claims, 1 Drawing Sheet

FIG. 1
PRIOR ART
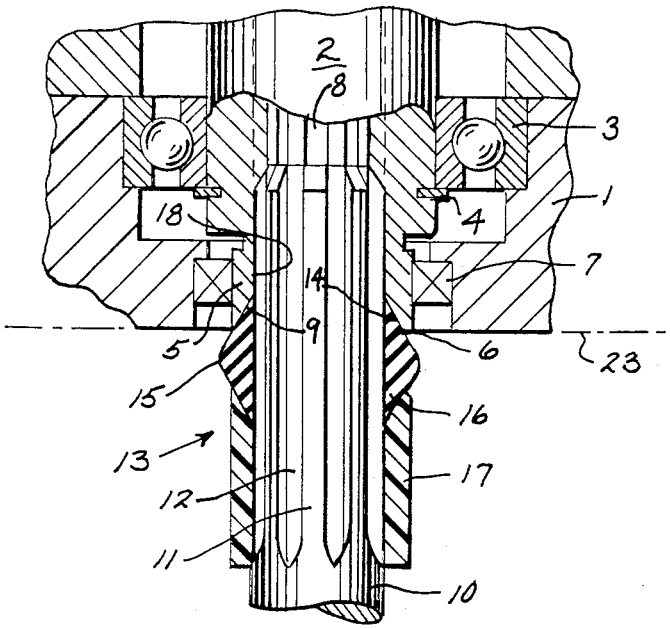
FIG. 2
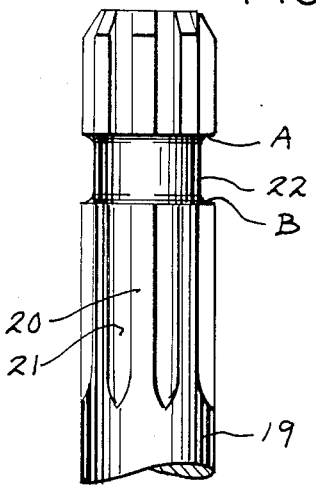
FIG. 3
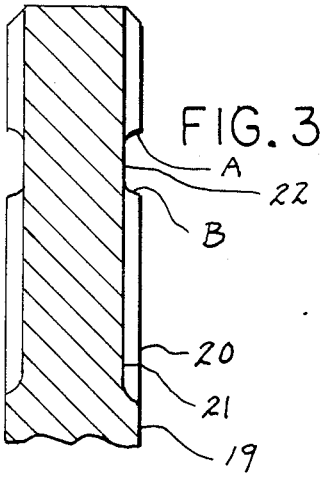
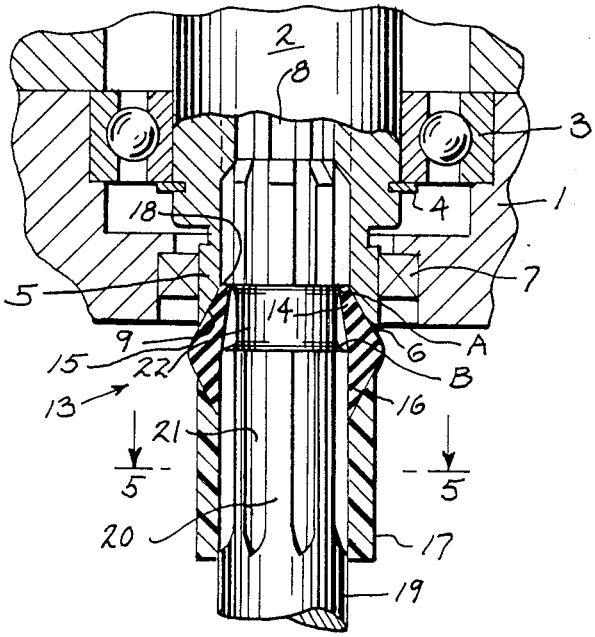
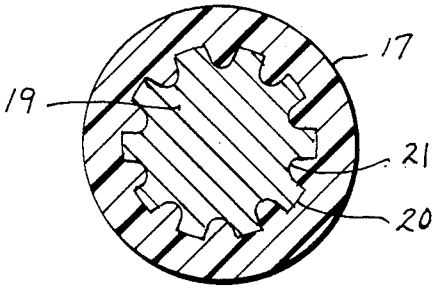
FIG. 5
FIG. 4

MARINE ENGINE DRIVESHAFT COUPLING

U.S. PRIOR ART OF INTEREST

| U.S. Pat. No. | Inventor | Issue Date |
|---|---|---|
| 3,337,221 | Hulsebus et al | August 22, 1967 |
| 3,350,879 | Boda et al | November 7, 1967 |

BACKGROUND AND SUMMARY OF THE INVENTION

This invention relates to a marine engine driveshaft coupling, and more particularly to the coupling between the crankshaft and upper driveshaft end in an outboard motor or the like.

The above identified U.S. Pat. No. 3,350,879 is illustrative of an outboard motor having an engine and an elongated driveshaft, which drives a propeller disposed in the device's lower unit. U.S. Pat. No. 3,337,221 illustrates one form of connection between the crankshaft and driveshaft of an outboard motor.

In known prior constructions, the crankshaft is mounted for rotation in the engine housing and includes a splined rotor hub adapted to receive the upper splined end of an elongated relatively rigid driveshaft, forming a coupling therebetween. The driveshaft has normally been of a constant outside diameter (O.D.) throughout its length, with the O.D. of the splined portion being axially constant. The inner diameter (I.D.) of the splined portion of the crankshaft has normally been dimensioned to mate with the splined portion of the driveshaft. The respective splined portions of the assembled driveshaft and crankshaft intersected adjacent the entrance of the driveshaft into the crankshaft, that is, at or near the outer terminus of the crankshaft.

Problems have arisen at the area of intersection of the shafts, in that the coupling tended to fail in this area. In attempting to locate the cause of the problem, stress risers or wear areas were observed in one or both of the members adjacent their intersection. It was determined that the driveshaft was too rigid and that the resulting stress risers or wear areas caused fatigue of the metal parts, which ultimtely caused the coupling failure.

One attempt to solve the problem was to taper the upper end of the driveshaft, including its splined portion, but such a construction was found to be very expensive to manufacture.

It is an object of the invention to solve the problem of failure of the crankshaft-to-driveshaft coupling of a marine engine in a simple and reasonably economical manner.

In accordance with the various aspects of the invention, the splined portion of the upper end of the driveshaft is provided with means to mechanically reduce the driveshaft rigidity by providing an intermediately positioned groove or undercut therein. The depth of the undercut is contemplated as being approximately the same as the channels between the splines, and the axial extent or length of the undercut is contemplated as being approximately equal to or greater than the undercut depth. In the assembled unit, the undercut is positioned at the outer terminus of the crankshaft. The result is a coupling wherein the rigidity of the driveshaft is reduced and it is free to flex more easily at the intersection of the members so that the stress riser area is relieved and fatigue failure is substantially reduced. The construction furthermore, provides greater compliance and allows for more mis-alignment than with the known devices.

BRIEF DESCRIPTION OF THE DRAWINGS

The accompanying drawings illustrate the best mode presently contemplated by the inventor for carrying out the invention.

In the drawings:

FIG. 1 is a fragmentary axial cross-sectional view of a portion of a marine engine coupling, showing the prior known construction;

FIG. 2 is a fragmentary perspective view of the upper end of a driveshaft constructed in accordance with some of the aspects of the present invention;

FIG. 3 is an axial longitudinal section through the driveshaft of FIG. 2;

FIG. 4 is a fragmentary axial cross-sectional view of the asembled coupling in accordance with the various aspects of the present invention; and FIG. 5 is a transverse section taken on line 5—5 of FIG. 4.

DESCRIPTION OF THE PREFERRED EMBODIMENT

The known structure shown in FIG. 1 includes the housing 1 of the engine of an outboard motor or the like, such as that shown in U.S. Pat. No. 3,350,879, which is incorporated herein by reference. A crankshaft 2 is rotatably supported on housing 1, as by a bearing 3 which is held in place by a snap ring 4. Crankshaft 2 includes a rotor hub 5 which has an outer terminus 6 which is positioned in general coextensive relationship with the outer housing wall. A suitable annular seal 7 is disposed between hub 5 and the housing. The inner portion of hub 5 is provided with radial splines 8. Furthermore, the interior of the outer hub end portion is tapered radially inwardly in an upward direction from terminus 6, as at conical internal taper 9.

The structure just described is adapted to form an assembly with and be coupled to the upper end of a driveshaft 10, the lower end of which is connected to drive the outboard motor propeller, not shown. The body of driveshaft 10 has a generally constant O.D., and its upper end portion is provided with axially extending radial splines 11 forming axial channels 12 therebetween. The O.D. of splines 11 is constant in an axial direction, with the spline edges being generally of the same diameter as that of the unsplined lower driveshaft portion.

Driveshaft 10 is received within crankshaft 2 with the driveshaft splines 11 closely interfitting with crankshaft spline 8. Furthermore, a sleeve-like splined annular rubberlike seal 13 is mounted to driveshaft splines 11. Seal 13 is of reverse conical shape having a tapered upper end portion 14 which is received within the space between axial driveshaft 10 and hub taper 9, and having a central enlarged portion 15 exteriorly of housing 1 as well as a tapered lower end portion 16. End portion 16 is in turn received within the upper end portion of a splined tube 17 of nylon or the like, which is also mounted to driveshaft 10.

Driveshaft 10 engages crankshaft 2 closely adjacent terminus 6, as at the upper end 18 of taper 9. With this construction, as driveshaft 10 rotates with crankshaft rotor hub 5, any misalignment or unbalance of the relatively rigid driveshaft will cause stress and fatigue to occur in the area of terminus 6, including taper upper end 18 , to the point of failure.

In accordance with the various aspects of the invention, and referring now to FIGS. 2 and 3, a driveshaft 19 is provided which is generally similar to driveshaft 10 of FIG. 1, and including radial splines 20 having axial channels 21 disposed therebetween. However, in this instance, an annular cylindrical groove or undercut 22 is machined into the intermediate portion of the driveshaft splined portion. The depth of undercut 22 is about equal to that of splines 20 so that the undercut diameter approximates the minor diameter of splines 20 and the driveshaft diameter in the area of channels 21. Upper and lower end portions A and B respectively, define the axial length of undercut 22. The ratio of the axial length of undercut 22 to its depth approximates a number equal to or greater than the numeral "one". The body of driveshaft 19 is weakened in the area of undercut 22.

FIG. 4 illustrates the assembly of driveshaft 19 of FIGS. 2 and 3 with the housing-crankshaft elements of FIG. 1, which are similarly numbered. It is to be noted that, in the assembly, undercut 22 is axially positioned adjacent outer crankshaft terminus 6 including the upper end 18 of taper 5. Undercut 22 bisects a transverse plane 23 containing terminus 6. The length A-B of undercut 22 is such that the latter commences axially inwardly of end 18 and ultimately terminates axially outwardly of crankshaft terminus 6.

The weakening and resultant mechanical rigidity reduction of driveshaft 19 in the area of undercut 22 permits the driveshaft to flex during high speed driving rotation thereof, with the flexing primarily taking place in the area previously subject to coupling-causing stress risers and the like; that is, adjacent the intersection of shafts 2 and 19. This natural flexing is not transmitted to the outer end portion of the crankshaft, and substantially reduces undesirable damaging forces between the splined tip of the driveshaft and the crankshaft.

Various modes of carrying out the invention are contemplated as being within the scope of the following claims particularly pointing out and distinctly claiming the subject matter which is regarded as the invention.

I claim:

1. In an outboard motor or the like, the combination comprising:

(a) a marine engine having a housing (1), (b) an axially extending engine crankshaft (2) mounted for driving rotation in said housing, said crankshaft having axial splines (8), (c) an axially extending relatively rigid driveshaft (19) having an upper end body portion mounted for rotation with said crankshaft when the latter is drivingly rotated, (d) said drive shaft having an axially extending splined portion disposed on said upper end portion thereof, (e) said splined portion of said driveshaft intersecting and being received within said crankshaft and co-engaging with said crankshaft splines, (f) and means (22) to mechanically reduce the rigidity of said splined portion of said driveshaft adjacent the latter's intersection with said crankshaft so that said driveshaft, when rotating with said crankshaft, flexes adjacent said intersection upon the application of material fatiguing stresses and without transmitting flexing forces to said crankshaft at said intersection, (g) said rigidity reducing means comprising an annular axially extending undercut (22) disposed wholly within said splined portion of said driveshaft (19), (h) said crankshaft (2) having an outer terminus (6) at least partially defining said intersection, (i) and said undercut (22) containing a plane disposed transverse to said crankshaft and containing said terminus.

2. The combination of claim 1

(a) wherein the outer end of said crankshaft (2) has a conical internal taper (9) extending axially inwardly to an inner taper end (18), (b) and said undercut (22) extends from axially inwardly of said taper end to axially outwardly of said crankshaft terminus.

3. The combination of claim 1 wherein:

(a) said driveshaft splined portion includes alternate axially extending radial splines (20) and channels (21) therebetween, (b) and the depth of said undercut (22) approximates that of said last-named splines.

4. The combination of claim 1 wherein:

(a) said driveshaft splined portion includes alternate axially extending radial splines (20) and channels (21) therebetween, (b) and the axial length of said undercut (22) is about equal to or greater than the radial depth of said last-named splines (20).

5. The combination of claim 1 wherein:

(a) said driveshaft splined portion includes alternate axially extending radial splines (20) and channels (21) therebetween, (b) the depth of said undercut (22) approximates that of said last-named splines, (c) and the axial length of said undercut (22) is about equal to or greater than the radial depth of said last-named splines (20).

* * * * *